US010786833B2

(12) United States Patent
Tupper

(10) Patent No.: US 10,786,833 B2
(45) Date of Patent: Sep. 29, 2020

(54) PRUNER CLEANER

(71) Applicant: Clean Scissors LLC, Grass Valley, CA (US)

(72) Inventor: Robert R Tupper, The Dalles, OR (US)

( * ) Notice: Subject to any disclaimer, the term of this patent is extended or adjusted under 35 U.S.C. 154(b) by 0 days.

(21) Appl. No.: 16/708,380

(22) Filed: Dec. 9, 2019

(65) Prior Publication Data

US 2020/0114397 A1 Apr. 16, 2020

Related U.S. Application Data

(63) Continuation-in-part of application No. 16/403,480, filed on May 3, 2019, now Pat. No. 10,506,764, which is a continuation-in-part of application No. 16/012,493, filed on Jun. 19, 2018, now Pat. No. 10,293,382.

(60) Provisional application No. 62/815,206, filed on Mar. 7, 2019, provisional application No. 62/530,461, filed on Jul. 10, 2017.

(51) Int. Cl.

| | |
|---|---|
| ***B08B 1/04*** | (2006.01) |
| ***A46B 13/02*** | (2006.01) |
| ***A46B 9/06*** | (2006.01) |
| ***A46B 13/00*** | (2006.01) |
| ***A46B 9/02*** | (2006.01) |
| ***A46B 15/00*** | (2006.01) |
| ***B08B 3/04*** | (2006.01) |
| ***B08B 1/00*** | (2006.01) |

(52) U.S. Cl.

CPC ..... *B08B 1/04* (2013.01); *A46B 9/025* (2013.01); *A46B 9/06* (2013.01); *A46B 13/001* (2013.01); *A46B 13/02* (2013.01); *A46B 15/0097* (2013.01); *B08B 1/002* (2013.01); *B08B 3/04* (2013.01); *A46B 2200/30* (2013.01); *B08B 2220/01* (2013.01)

(58) Field of Classification Search

CPC .. B08B 1/04; B08B 1/002; B08B 3/04; A46B 9/025; A46B 9/06; A46B 13/00; A46B 13/001; A46B 13/02; A46B 15/0097; A46B 2200/30; B24B 29/005; B24B 45/00; B24B 47/10

USPC ..... 451/112

See application file for complete search history.

(56) References Cited

U.S. PATENT DOCUMENTS

| | | | | | |
|---|---|---|---|---|---|
| 72,067 | A * | 12/1867 | Merritt | B24B 19/002 | 451/112 |
| 1,449,457 | A * | 3/1923 | Sullivan | B24B 19/002 | 451/112 |
| 2,472,155 | A * | 6/1949 | John Gaino | A47L 4/00 | 15/77 |
| 5,903,951 | A * | 5/1999 | Ionta | A46B 3/005 | 15/180 |
| 6,145,147 | A * | 11/2000 | Frecska | B08B 1/04 | 15/77 |
| 8,332,983 | B1 * | 12/2012 | Prohoroff | A47L 11/4038 | 15/176.6 |
| 2004/0031117 | A1 * | 2/2004 | Gaser | A46B 13/003 | 15/179 |

(Continued)

*Primary Examiner* — Christopher R Harmon

(57) ABSTRACT

A pruner cleaning machine scrubs gummy sap and foreign matter from pruner blades inserted into its cleaning chamber. The machine includes a motor turning a drive shaft assembly having scrubbers coupled thereon. The scrubbers have scrubbing surfaces facing each other and a central scrubber element resides between the scrubbers.

20 Claims, 3 Drawing Sheets

(56) References Cited

U.S. PATENT DOCUMENTS

| | | | | |
|---|---|---|---|---|
| 2006/0229003 | A1* | 10/2006 | Rhoades | B24B 31/116<br>451/112 |
| 2009/0241989 | A1* | 10/2009 | MacNeil | A46B 13/008<br>134/6 |
| 2014/0007368 | A1* | 1/2014 | Larson | A47L 11/283<br>15/256.5 |

* cited by examiner

PRUNER CLEANER

PRIORITY: CROSS-REFERENCE TO THE RELATED APPLICATION

This non-provisional utility patent application is a continuation in part of non-provisional utility patent application Ser. No. 16/403,480 "Pruner Cleaner," filed 3 May 2019, and this application claims all available benefits of priority to its parent application.

The parent application, non-provisional utility patent application Ser. No. 16/403,480 "Pruner Cleaner," filed 3 May 2019 is a continuation in part of non-provisional utility application Ser. No. 16/012,493 "Plant Trimming Shear Cleaner and Sharpener" filed 19 Jun. 2018 which issued 21 May 2019 as U.S. Pat. No. 10,293,382.

Application Ser. No. 16/012,493 "Plant Trimming Shear Cleaner and Sharpener" filed 19 Jun. 2018 claims the benefit of and priority to U.S. Provisional Application 62/530,461 "Plant Trimming Shear Cleaner and Sharpener," filed 10 Jul. 2017.

Both this application and non-provisional application Ser. No. 16/403,480 "Pruner Cleaner," filed 3 May 2019 claim the benefit of and priority to U.S. Provisional Application 62/815,206 "Pruner Cleaner," filed 7 Mar. 2019.

The entire contents of U.S. Provisional Application 62/530,461 "Plant Trimming Shear Cleaner and Sharpener," filed 10 Jul. 2017, U.S. Provisional Application 62/815,206 "Pruner Cleaner," filed 6 Mar. 2019, non-provisional utility patent application Ser. No. 16/012,493 "Plant Trimming Shear Cleaner and Sharpener," filed 19 Jun. 2018, and non-provisional application Ser. No. 16/403,480 "Pruner Cleaner," filed 3 May 2019 are hereby incorporated into this application document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates generally to a plant trimming shear cleaner and sharpener.

BACKGROUND OF THE INVENTION

Many types of plants have thick, viscous, or gummy sap or resin in their stalks and other parts, and when trimming, pruning, or harvesting, the shearing or cutting tools used often accumulate sticky residues which can in turn pick up other foreign matter such as dust, fines, or clippings. Over time the tool becomes increasingly difficult to use or to control safely, halting the work while the tool is cleaned. Currently there are a number of methods used to attempt to clean off sticky residue from shears, pruners, or gardening scissors. One of set of methods involves soaking a fouled tool or at least the cutting blades or edges of the tool in a cleaning solution, or oil impregnated sand, or other sorts and mixtures of solvents or abrasives, but these methods fail to satisfy market needs because of how long the trimmers need to be soaked or cycled within the cleaning medium, and the additional steps required to remove gritty abrasive cleaners before returning the tool to service.

Attempts to sharpen gummed up plant trimming shears are often inadequate because although sharpening may remove gummy residue and foreign matter from the immediate area of the tool's cutting surfaces, the rest of the tool will remain substantially fouled. Worse, gummy residues transferred to the sharpening tool will impede subsequent sharpening attempts. Eventually both the cutting tools and the sharpening tools alike will still need to be cleaned.

Working on resinous plants with cutting or pruning tools requires more frequent instances of cleaning and sharpening the tools, and it is often attempted to devise portable cleaning and sharpening tools which can be worn by a gardener or field worker or kept close by a site where pruning, cutting, or harvesting is in progress.

Cleaning scissors by hand usually requires rags, open containers of solvents and presents uses with cutting hazards. Contaminated rags may contribute to impurities in valuable products. Where cleaning solvents are used, evaporation, odors, ventilation contribute additional challenges and opportunities for hazards and waste, and users may be exposed to undesired contact with these cleaning agents and plant materials or their extracts suspended therein in the event of a spill or a leak.

Where purity of plant extracts is an objective, contamination becomes a concern because a used rag can transfer contaminants or fine matter between supposedly clean tools. When harvesting plants for medical compounds, people who clean the cutting tools risk receiving a transfer of active agents in plant oils into the body, which can precipitate allergic reactions or an unintended dose of psychotropic medicinal compounds, or unwanted hormonal responses to chemicals intended to alleviate medical conditions not present in an affected user.

BRIEF SUMMARY OF THE INVENTION

From the aforementioned background it is understood that many objectives exist for a device for cleaning pruners, clippers, shears, or other gardening or harvesting tools used with plants that exude any sort of viscous, sticky saps or resins likely to gum up the mechanical workings of such a cutting tool.

Thus, a primary objective of the invention is to provide an apparatus that scrubs plant trimming shears and removes residues from blades rather than having them transferred into a rag which can then contaminate other tools.

A corollary objective of the invention is to provide motive power to moving parts of scrubbing and blade cleaning components and mechanisms of the invention. Another corollary objective of the invention is to ensure scrubbing materials contact and clean most if not all shearing surfaces of an inserted pruning tool. Another corollary objective of the invention is to provide scrubbing motions and durations in regimens which effectively clean the inserted tool.

Yet another objective of the invention is to provide an effective cleaning and scrubbing mechanism which is robust and able to withstand accidental and some intentional misuse, and further corollary objectives of the invention are that the machinery is mechanically simple and that the components may be produced at modest cost.

Another objective of the invention is to present a cleaning solution or solvent to fouled portions of the tool or at least the cutting surfaces thereof. A corollary objective of the invention is to separate unwanted, gummy residue from cutting surfaces and mechanisms of the cutting tool, by mechanical actions or chemical actions or both.

Another objective of the invention is to provide means for a pruner cleaning apparatus to be kept nearby and ready to clean a pruner in a variety of workspaces including not only work benches but also near anywhere pruning work is in progress, such as on a ladder.

Another objective of the invention is to reduce or prevent loss or spillage of cleaning solution retained in a reservoir within the tool cleaning device. A corollary objective of the invention is to close admittance to or egress from the reservoir when the device is not in use.

Another objective of the invention is to protect the user from contact with any mechanisms or components of the device which may present an opportunity for injury or damage such as pinching hazards, exposed surfaces or edges of sharpening tools especially while in motion, or powered reciprocating or rotating machinery that may catch and wind up clothing or other foreign objects.

A further objective of the invention is to provide a machine having portions which are easy to disassemble so as to allow access for exchanging scrubbing components when these become worn, reconfiguring brushes or discs of various bristle configurations or degrees of abrasiveness, or adjusting the spacing between scrubbing components for pruners having various blade configurations. A corollary objective is to provide internal cowlings or shrouds which are difficult or non-intuitive to remove, so as to protect precision, factory adjusted mechanisms, circuit boards, and high energy wiring from unauthorized meddling.

Various devices are currently available which attempt to address these challenges, although they may at best meet only one or two aspects of the totality of the requirements.

BRIEF DESCRIPTION OF THE DRAWINGS

A further understanding of the nature and advantages of particular embodiments may be realized by reference to the remaining portions of the specification and the drawings. Similar reference numerals are used to refer to similar components.

DETAILED DESCRIPTION OF THE INVENTION

Figure 1:
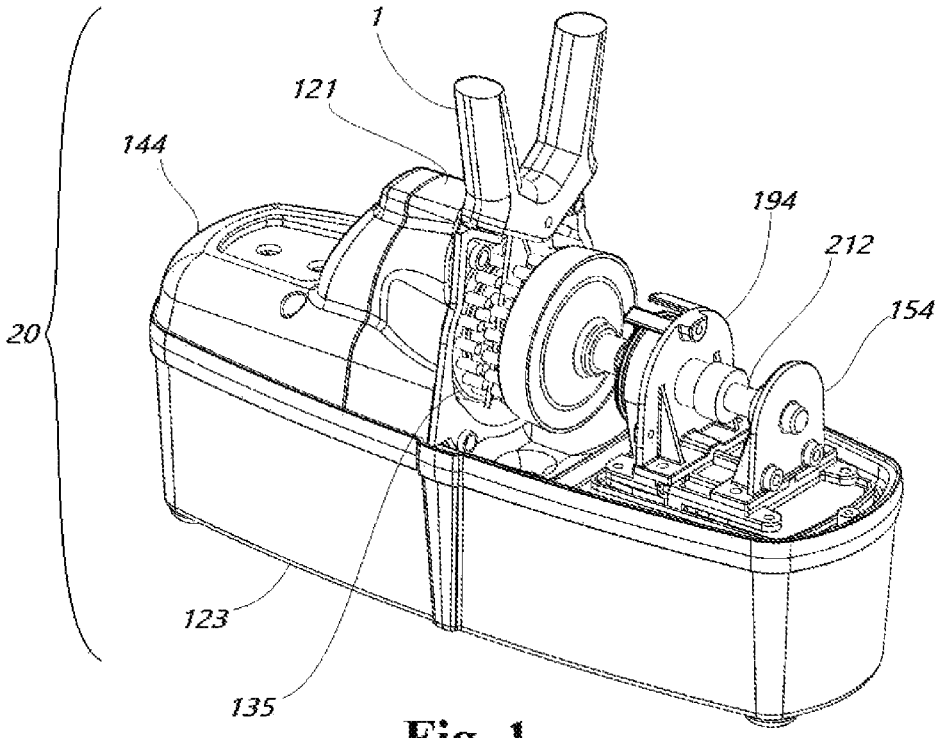
FIG. 1 shows an oblique, top right front view of an embodiment in accordance with the invention, with some of its housing components removed.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this specification, the term "means for . . . " as used herein including the claims, is to be interpreted according to 35 USC 112 paragraph 6. Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification any singular grammatical gender may subsume any other singular grammatical gender in all cases, and any plural grammatical gender may subsume any other plural grammatical gender in all cases. A user of the invention may be of any biological sex, thus all instances where "he," "his," or "him" are written may be replaced by "she," or "her," as appropriate, to equivalent meaning, effects, intents, and purposes. Also, grammatically irregular plural forms are recognized as their plain language equivalents, so that terms such as "at least one foot" are understood to be equivalent to "both feet" and other similar phrases of equivalent meaning.

"Pruner" in this specification includes any and all manner of hand-operated gardening tools designed to cut plant parts such as stems, leaves, stalks, twigs, and branches and the like, mostly by means of bringing together two slightly offset blades to rupture the material being cut by shearing stress overcoming the material strength. "Pruners" in this specification also include scissors, shears, clippers, and other similar hand operated devices having at least two handles or levers connected by a pin so that a grasping hand can pinch and sever plant matter by means of the tool's cutting blades operating at a mechanical advantage which multiplies the user's grasping or clenching force.

The phrase "operably coupled" and its derivative phrases such as "for operably coupling," when used such as "[A] is operably coupled to [B]" means that when [A] is operated then [B] is caused to operate. The operation of [B] in response to [A] may incorporate but not be limited to a direct relation, a proportional relation, or an inverse relation, and time delays may be designed in between the actuation of device or controller [A] and the behavior of [B.] The phrase "[A] is operably coupled to [C] by means of [B]" means that [A] is operably coupled to [B] and [B] is operably coupled to [C,] so that the intermediate component or system [B] may act as a modulating influence on the operation of component or system [C] in response to actuations of device or controller [A.] The operation of [C] in response to [A]

may incorporate but not be limited to a direct relation, a proportional relation, or an inverse relation. Time delays may be incorporated between [A] and [B] or between [B] and [C] or both between [A] and [B] and between [B] and [C.]

Some plants exude gummy sap or other highly viscous or sticky fluids which transfer to a cutting tool during pruning, harvesting, or maintenance performed on plants. The gummed-up tool is harder to operate safely and effectively. In one class of embodiments, the invention is a pruner cleaner available in several embodiments, some being portable on the person for workers doing landscaping, harvesting, or pruning chores, and others being designed for use at a workbench or table where a person can clean batches of fouled tools and return them into service. A portable embodiment may include a clip or attachment for affixing the pruner cleaning machine to a ladder tread, vehicle tailgate, or other such surface for mobile work.

A pruner cleaning machine scrubs gummy sap and foreign matter from pruner blades inserted into its cleaning chamber. The machine includes a motor turning a driveshaft having scrubbers coupled thereon. The scrubbers have scrubbing surfaces facing each other and a central scrubbing element called a scrubber barrel resides between the scrubbers.

The invention replaces an inefficient, one-handed cleaning process which is seldom performed effectively or completely. Existing practice which the invention improves on and substantially eliminates is a generally unstructured and poorly controlled process whereby three or four fouled pruners are dropped into glass jars and left to soak for uncontrolled durations of time.

Since cleaning fluids are deposited into open jars the use of highly volatile but otherwise effective solvents is precluded because of loss by evaporation and spill risks. Thus the jar soak method is limited to heavier oils such as salad oil which may be less effective than d-limonene or 90% ethanol, or other volatile cleaners such as methanol, turpentine, methyl-ethyl ketone, kerosene, or denatured alcohol.

Rapid evaporation of volatile but effective solvents is not only needlessly expensive but may also expose workers to organic compounds in a vapor state which cause unwanted effects or health hazards when inhaled. Some states may also impose legal limits on generating evaporated volatile organic compounds (VOCs) and have occupational safety codes governing how these products may be used indoors.

Another hazard is that prolonged contact with volatile solvents can draw the water out of workers' skin. Workers grasping plant matter to be pruned with one hand typically pull out a pruner that has been soaking a while with the other hand, and clean it off onto a rag in a one-handed motion which most often only swabs the flats of the pruning blades. Usually there is little control governing whether or not the first pruner pulled from the solvent was the first pruner to be inserted (FIFO) and little to ensure that all pruners are soaked for similar amounts of time as a cleaning treatment step.

After swiping the wide faces of the pruner blades onto a cleaning rag and flipping them over in one hand to swipe the other wide sides of the blades, the person must then rotate the pruner 90° and then 270° in order to clean all four active surfaces of a cutting tool.

Because of the cumbersome hand motions and the additional time required workers usually neglect to clean the edges of the blade, which are its most important cutting surfaces. Workers are typically unwilling to spend more than 30 seconds cleaning a tool or wiping off solvents, and over time rags containing accumulated foulings instead of cleaning the next set of pruners, begin to contaminate them with gunk from previously cleaned tools.

In contrast, by using the invention, a pruner can be inserted and cleaned much more quickly such as in the range of about 10-12 seconds, and immediately returned into service, with only an optional wipe-down to remove solvent on pruners which have already been completely cleaned in the machine. The invention thus eliminates the most tedious portion of the cleaning task which is also the task least often attempted and least often completed successfully: that of cleaning the most important cutting surface of the pruner which are its leading edges of the cutting blades.

The cutting edges typically face each other within an acute angle of the open jaws of a pruner, which means they are the least accessible to traditional swabbing methods which use rags or tools, and also inhere the most risk of accidental lacerations, a risk which increases when work is done hurriedly and unfastidiously. A thorough and careful cleaning of pruners by hand usually takes about five minutes.

In a typical mode of operation, the invention may thus save about 10-15 minutes per hour of non-productive overhead work and its associated labor cost to a business. In another example, if workers clean tools about 12 times an hour and spend 30 seconds on each tool while often getting incomplete results, use of the inventive machine eliminates two thirds of the time spent cleaning tools.

The inventive machine is also a lot less messy and eliminates workers needing to move their fingers near sharp cutting edges, because the edges are enclosed safely within the housings of the machine while cleaning is in progress.

At most, the workers only need move the pruner up and down within the machine and optionally only apply light lateral pressure, or apply a twist, or a light squeeze to the pruner handles to engage the blades with the scrubbers inside the cleaning chamber of the machine.

The motor may be electronically controlled to provide adjustable regimens of duty cycles of scrubbing in forward and reverse directions and at various speeds, and status lights may indicate power available, selected options, and in-process phases and completion of a cleaning regimen.

The apparatus fulfills the need for a pruner soaking and cleaning device. The invention is reusable. Among other things, it is an advantage of the invention to provide a plant trimming shear cleaner and sharpener that does not suffer from any of the problems or deficiencies associated with prior solutions. Some embodiments include a battery operated motor. A motor may be controlled by a pulse width modulator, because this means of motor control retains high torque at low speeds, or a motor may be a stepper motor.

Referring to the figures, FIG. 1 shows an oblique, top right front view of an embodiment of the invention [20,] with a set of pruners [1] positioned above a pruner receiving orifice in accordance with the invention. Two half-housings are roughly symmetrical about a midplane and each half housing has a shroud, cowling, or housing extension affixed to it and distal to the midplane. One half housing [121] and its housing extension [144] are shown and the other half housing and its housing extension are omitted to expose certain internal components. The omitted housing components are substantially symmetrical to the components shown in this figure. Housing extension [144] attaches to half-housing [121]. The housing extensions include sites where they may be attached to a lower well [123] such as by cap screws or other hardware. At the discretion of a manufacturer, detaching a half-housing and its attached extension from the lower well may or may not be an authorized service.

Two scrubbing discs [135] which may also be called scrubbers, are coupled to the drive shaft for rotation therewith. A countershaft [212] is mounted to a first countershaft mount plate [154] which affixes to the motor face where its shaft exits its housing, and a second countershaft mount plate [194] on the other side of the reduction gearing from the motor. The countershaft is retained within bearings or bushings at each countershaft mount plate and is driven by a motor down below in the well via a belt and sheave drive which drives the shaft holding the scrubbers.

Smooth sheaves having a "V" cross section may be used with simple drive belts having a trapezoidal cross section which fits within the sheave. According to alternate embodiments, the drive belt may include longitudinal or transverse ribs with complementary splines or grooves in the sheaves to comprise a positive traction drive. Belts having transverse ribs may also be called timing belts, and these interoperate with timing belt sheaves which include grooves or drive features complementary to the ribs of the timing belt.

Belt tension may be adjusted by the spacing between the sheaves so that the drive is allowed to slip if a level of drive torque demanded by the scrubbing system and the inserted pruners is exceeded. Allowing the drive to slip when the scrubbing components become stalled acts as a mechanical fuse or weak link to protect the other drive components and the drive motor, such as if for example a foreign object inserted where pruners are normally scrubbed were to suddenly jam the works to a halt. A drive belt and sheave set adjusted to act as a slipping clutch may also prevent injury if fingers or a hand were to be inserted or entrained into the rotating scrubbing components, so that they slow or stop rather than continue at full speed and power possibly sufficient to macerate or otherwise injure the fingers or the hand. This hazard exists when users wear long-cuffed sleeves or long, unconstrained hair in proximity to a running machine or when the plants being cut include long vines, roots, or other fibrous stands which may get wound around the drive shaft or other rotating components and thereby present an opportunity to coil around and entrain a user's clothing, hair, gloves, or fingers.

A summary of drive components for operably coupling a shaft assembly of a scrubbing machine in accordance with the invention to a countershaft or operably coupling to a motor output shaft may thus include: a sheave, a drive belt, a V-belt, a timing belt, a timing belt sheave, a silent chain, a silent chain sprocket, a dog clutch, a slipping clutch, a universal joint, a drive belt having a transverse rib, a drive belt having a longitudinal rib, and a spur gear.

The housing extensions may be permanently mounted to their housings, such as by adhesives or by threaded hardware which can be disassembled for authorized service. Stickers or seals may be affixed across the interface of a half housing and its extension so that tampering or unauthorized disassembly may be evinced and trigger a cancellation of warranty or other rescission of manufacturer's support or good will. Stickers or seals may also be affixed across enclosures which house or contain electronics for reduction of liability in the event that unauthorized access or tampering leads to a malfunction or other event leading to product liability litigation, whereupon such unauthorized tampering may be evinced.

Figure 2:
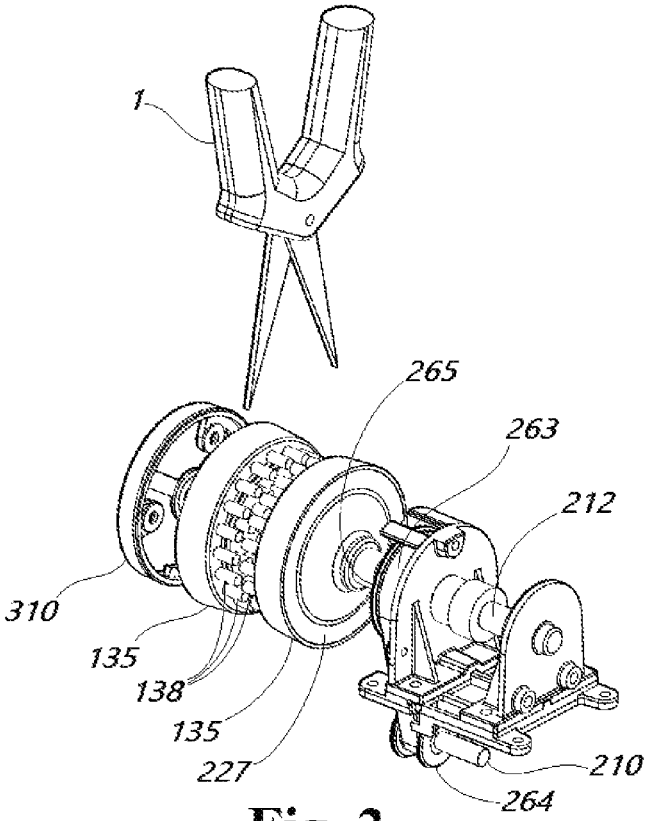
FIG. 2 shows an embodiment of a set of scrubbers in accordance with the invention, and a drive train embodiment for powering them.

FIG. 2 shows an embodiment of a set of scrubbers in accordance with the invention, and a drive train embodiment for powering them. In one set of embodiments on the scrubbers [135] each having pluralities of bristles [138] arranged in tufts which are made of materials selected for rejection and lack of adhesion to typical plant matter, plant oils, syrups, and saps as well as solvent resistance. The proximity of the discs may be set so that the tuft ends extend into each other or there may be a clearance between them. In a preferred embodiment the discs are disposed symmetrically apart from a midplane of the machine. The bristles may extend from the scrubbing face of the scrubber past the midplane of the drive shaft assembly so as to interdigitate with bristles extending from the scrubbing face of the scrubbing disc on the opposite side of the midplane. While cleaning the blades of an inserted pruner, the discs will pick up axial reaction forces tending to axially splay the discs apart from each other. Additionally, friction between the bristles and the blade surfaces being cleaned is presented to the scrubbers as a dragging torque which consumes the rotary power transmitted by the drive shaft. Because most of the torsional power is consumed along the periphery of the discs, each disc also includes a support hub [227] which assists with the transfer of a portion of the torsional scrubbing from the drive shaft to the scrubber perimeter where it is consumed. A scrubbing disc may also include a two-part subassembly wherein a scrubbing disc is a circular shell comprising a scrubbing face with its bristles or tufts, and a circular perimeter wall to form a cup into which the support hub inserts and provides radial structural support.

A shaft end support plate [310] supports the distal end of the drive shaft by means of a bushing or a bearing disposed within a central aperture. This support is radially enclosed between the lower well and the housing extension within which it resides, so that it provides structural support to the housing extension and also aids in reducing, absorbing, or otherwise redirecting mechanical vibrations that might otherwise be transmitted to the housing assembly.

Although various embodiments may include a belt drive, other means of power transmission from a motor shaft to a drive shaft of the invention are also contemplated within the scope of the invention, such as sprocket and chain drives and gearing operating between sheaves mounted on shafts and countershafts. As shown, an embodiment in accordance with the invention may include a drive belt [263] operating between a sheave [264] mounted on a motor output shaft [210] and another sheave [265] mounted on the countershaft [212]. A pruner [1] is depicted above for reference. In this figure the belt drive acts as a reduction mechanism, although a gear train is another alternative embodiment of a reduction mechanism operably coupled between a motor and a drive shaft.

Figure 3:
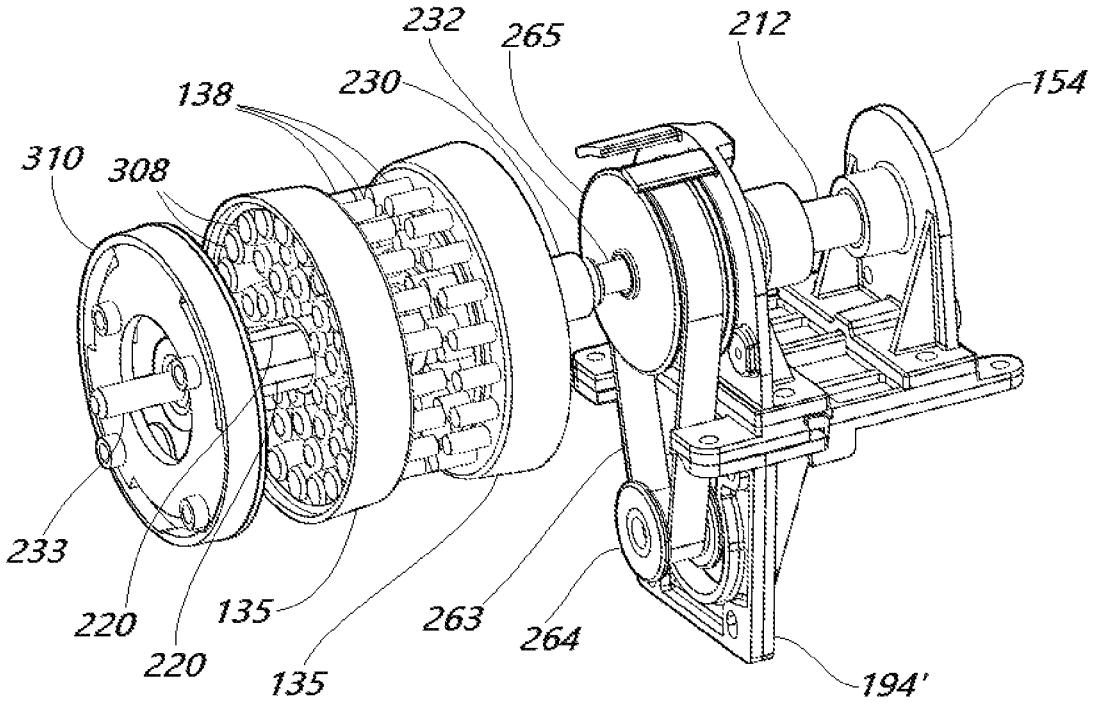
FIG. 3 shows the embodiment of the scrubbers and power train of FIG. 2, but from an alternate oblique view.

FIG. 3 shows the embodiment of the scrubbers and power train of FIG. 2, but from an alternate oblique view. The drive shaft is an assembly comprising an internal axle having a proximal end [232] coupled to the countershaft [212] for rotation therewith, and passing through the entire length of a spline shaft [230] to emerge at a distal end [233.] Alternatively, the spline shaft [230] may comprise proximal and distal ends each having a coaxial hole for receiving a proximal extension shaft [232] and a distal extension shaft [233] respectively. The coaxial holes may communicate with each other through an optional connecting hole extending the middle length of the spline shaft.

The distal end or distal extension shaft [233] is seated within a bearing or bushing lodged within the shaft end support plate [310] on the distal end of the scrubber and drive assembly. The shafts are pressed into the corresponding end of a spline shaft [230] which is keyed or grooved [220] in order to drive the associated scrubbers. In this specification the spline shaft may incorporate one or more sets of longitudinal splines or grooves, or both.

A scrubber assembly embodiment in accordance with the invention includes scrubbers [135] each having pluralities of bristles [138] arranged in tufts as explained above. The support hub [227 in FIG. 2] of the distal end of the scrubber assembly is omitted in this view to reveal the back side of the scrubber, which includes brush retention wells [308] which preferably may be overmolded to retain the tufts of bristles.

As seen previously, the drive shaft is an assembly comprising an internal axle having a proximal end [232] coupled to the countershaft [212] for rotation therewith, and passing through the entire length of a spline shaft [230] to emerge at a distal end [233.] Alternatively, the spline shaft [230] may comprise proximal and distal ends each having a coaxial hole for receiving a proximal extension shaft [232] and a distal extension shaft [233] respectively.

According to a preferred embodiment the scrubbers are disposed symmetrically apart from the midplane of the drive shaft of the machine. The midplane is perpendicular to the rotational axis of the shaft and is preferable located a distance from an end of the drive shaft which is between 30% and 70% of the length of the shaft inclusively. For example, for a 10 inch long shaft, the midplane would be preferably located within 3 inches and 7 inches inclusively from an end of the drive shaft. The shaft has two ends and the end from which the distance is taken to the midplane may be either of the two ends of the shaft. A shaft end support plate [310] provides structural support to the half-housing and supports that end of the drive shaft secured in a bearing within the housing extension so as to reduce vibration effects that would be transmitted to the housing assembly.

Although various embodiments as shown use a belt drive [263] to couple a first sheave [264] on the motor output shaft to a second sheave [265] mounted on countershaft [212,] other means of power transmission from a motor shaft to a drive shaft are also contemplated within the scope of the invention, such as sprocket and chain drives and gearing operating between sheaves mounted on shafts and countershafts. In the embodiment shown the belt drive acts as a reduction mechanism according to the ratio of the diameters of the first and second sheaves, although a gear train is another embodiment of reduction mechanism for operably coupling a motor to the drive shaft. The countershaft may be mounted in bearings or bushings retained by first and second countershaft mount plates [154] and [194',] wherein as opposed to the countershaft mount plate [194] of FIG. 2, in this embodiment shown the second countershaft mount plate extends into the lower well and also provides for retaining a bearing or bushing for the motor output shaft if required, depending on the mechanical configuration of the output shaft of the motor. Lifetime-lubricated "DU" bearings or similar oilimpregnated bronze, or Teflon-impregnated Delrin® or acetal, or similar lubricated bushings may also be used wherever "bearings" are mentioned in this specification.

Figure 4:
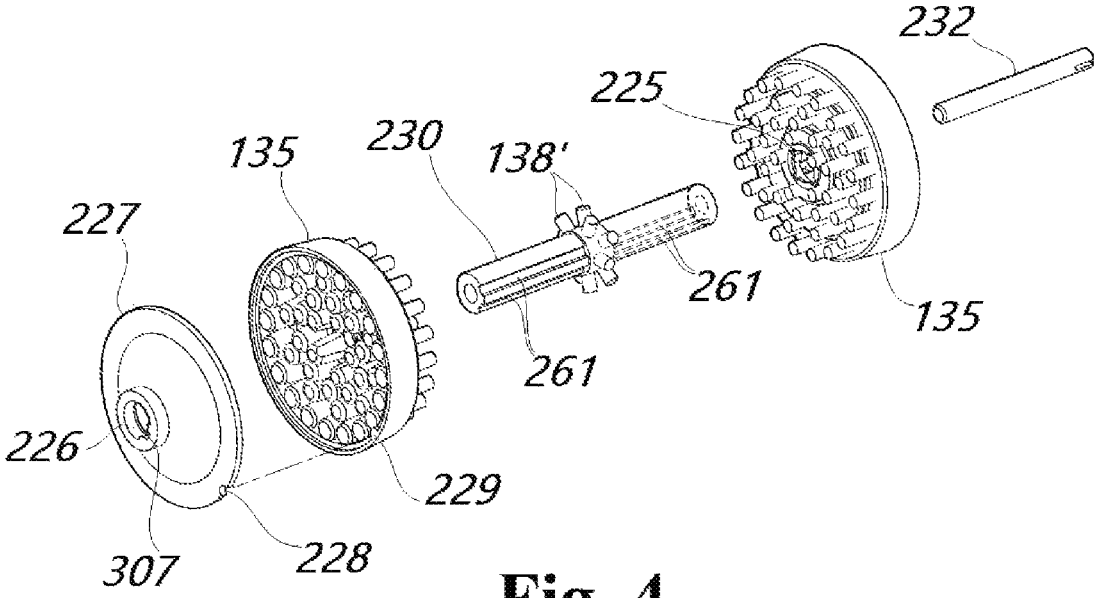
FIG. 4 shows an embodiment of scrubbers and a drive shaft assembly in accordance with the invention.

FIG. 4 shows an embodiment of scrubbers and a composite drive shaft assembly. The composite drive shaft includes a spline shaft [230,] a first proximal extension shaft [232] coupled to the countershaft described elsewhere, and a second distal extension shaft [223 of FIG. 3.] The proximal extension shaft may further comprise a double-D slotted end for engagement with a transverse pin held in a bushing coupled to the countershaft as described in the parent application. The transverse pin may also be made of a material and sized to fail in shear as a mechanical fuse if the scrubbers were to become suddenly jammed, so as to decouple the scrubbing mechanism from torsional power supplied by the drive motor.

Figure 5:
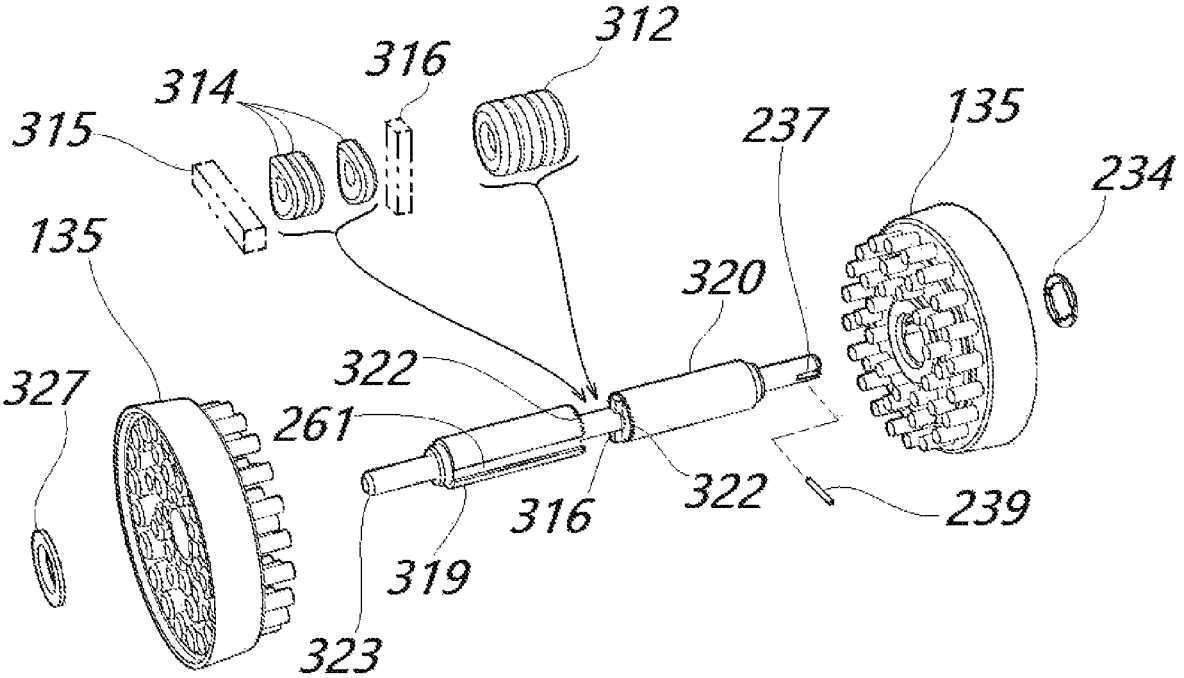
FIG. 5 shows an alternative embodiment of scrubbers and a drive shaft assembly in accordance with the invention which includes alternative embodiments for incorporating a grooved central scrubber barrel.

The spline shaft includes two coaxial apertures for receiving the extension shafts and also includes sets of longitudinal engagement features [261] which in some embodiments may be grooves, but in others may be strakes, keyways, or splines. The longitudinal engagement features engage with complementary rotational drive features such as teeth, notches, flat sections, keyseats or keys, in the inner periphery of the central apertures of the scrubbing discs. The sets of longitudinal engagement features may be arranged as a first set directed to engage with the rotational drive features of the central aperture [225] of the first scrubber, and a second set directed to engage with the rotational drive features of the central aperture of the second scrubber. The longitudinal engagement features rotate about the rotational axis of the drive shaft, either by being integral features of the drive shaft as shown in this figure, or by being integral to drive barrels coupled to the drive shaft as shown in FIG. 5.

Optionally the first set may be angularly offset from the second set so that the bristles of the first scrubber are radially offset from the bristles of the second scrubber, so that the two sets of bristles may interdigitate and extend past each other when assembled onto the spline shaft. In other words, juxtaposing the grooves in the drive barrel can enforce that when two scrubbers [135] are installed on the splined shaft so that they face each other, tuft arrays of one scrubber do not directly meet those of the opposed scrubber. Instead, the tuft arrays are "clocked" with respect to each other so that they interdigitate when brought together.

According to a preferred embodiment in accordance with the invention, a set of longitudinal engagement features comprises a first longitudinal groove or keyway and a second such longitudinal groove or keyway angularly offset from the first by 45° to 135°.

The spline shaft further comprises a barrel section defining a midplane halfway along its axial length. Two arrays of brushes [138'] are disposed on opposite sides of the barrel midplane, and with arrays of bristles or tufts angularly offset so that the sets of tufts are arranged interstitially around the circumference of the barrel. The scrubber has a back plate which is a support hub [227] that has a central aperture [226] and the scrubbers also may have central apertures, with both of these components preferably including rotational drive features complementary to the spline shaft grooves.

In the embodiment shown in this figure, the support hub is a conical support hub. According to an alternative embodiment in accordance with the invention, a scrubber is an assembly of components comprising a scrubbing face, and any of the components within the scrubber, such as the support hub may comprise a central aperture having a rotational drive feature complementary to the longitudinal engagement feature for coupled rotation with the drive shaft. A scrubber, or at least one of the two scrubbers in the pruner cleaning machine as an assembly may also comprise a slipping clutch operably coupled between its rotational drive feature and its scrubbing face to act as a mechanical fuse so that if the scrubber were to become suddenly jammed, the slipping clutch may decouple the scrubbing face from torsional power supplied by the drive motor. Alternatively, a slipping clutch may be incorporated within the central scrubbing barrel, and may operate either so as to decouple the scrubbing action of the scrubber barrel from torsional power supplied by the drive motor, or it may reside within the scrubber barrel but be operably coupled between the proximal extension shaft and the distal extension shaft of the shaft assembly.

According to an alternative embodiment, the rim of the conical support hub also includes a cutout [228] such as a semicircular cutout, and the rear face of a scrubber has a rear projecting protuberance [229] complementary to the cutout so that once the two components are brought together their central apertures become radially aligned.

FIG. 5 shows an alternative embodiment of scrubbers [135] and a drive shaft assembly in accordance with the invention which includes alternative embodiments for incorporating a central scrubber barrel [312.]

The central scrubber barrel may also alternatively comprise a stack of washers made of flexible, compressible, or cancellous material, axially spaced apart. Each of these alternative embodiments in this figure includes a pair of drive barrels [319, 320] which are assembled onto a drive shaft [323] to leave a gap between the drive barrels. The longitudinal engagement features [261] for angularly orienting and for transmitting drive power to the scrubbers rotate about the rotational axis of the drive shaft by being integral features of the drive barrels coupled to the drive shaft.

The mutually facing end faces of the drive barrels preferably include friction grip features along at least a portion of their rims. Friction grip features may be fashioned as an aggressive mold texture on an inward-facing end face of a drive barrel, or a circular array of axial protuberances such as castellations along a portion or a rim of an inward-facing end face of a drive barrel, or preferably they may be serrations [322] that bite into the material of the central scrubber barrel or barrel stack disposed between the drive barrels. The serrations aid in transferring rotary power from the drive shaft assembly to the central scrubber barrel or barrel assembly. One drive barrel may be permanently molded onto the drive shaft and the other or both may be removable for cleaning of the inward-facing blade. Optionally, the drive barrels may be secured to the drive shaft using set screws so that the angular offsets of the tufts of the scrubbing discs may be set and adjusted.

A central scrubber barrel which is a grooved barrel may be built up from a coaxial stack of chamfered washers or rings. Additionally the grooves may be deformed into serpentine or wavy grooves by having the mutually inward-facing end faces of the drive barrels include transverse ridges [315, 316.] The ridge portions of the drive barrels are shown as phantom objects astride of an axially stacked set of washers [314.] When the ridge feature of one drive barrel end face is oriented perpendicular or at an angular offset to the ridge of the other drive barrel end face, the drive barrels may be brought together to compress the washer stack between them. The angular offset between a given first transverse ridge on a first inward-facing end face of a first drive barrel and a second transverse ridge on a second inward-facing end face of a second drive barrel deforms the stack of washers residing between these mutually inward-facing end faces into a wavy shape. Specifically, an angular offset between a first transverse ridge on a first inward-facing end face of a first drive barrel and a second transverse ridge on a second inward-facing end face of a second drive barrel creates and enforces an undulation in a portion of a rim of at least one of the chamfered washers in the axial stack of washers comprised within the scrubber barrel. A plurality of these undulations creates a wavy washer subassembly.

Larger numbers of waves may be created by increasing the number of transverse ridges on the end faces of the drive barrels, such as having three ridges on each face arranged 120° apart and with the ridges of one end face "clocked" 60° with respect to the ridges of the other end face, or with four ridges on each face arranged in quadrature and with the ridges of one end face "clocked" 45° with respect to the ridges of the other end face, and so forth.

The drive shaft includes at its proximal end a transverse slot [237] which is operably coupled to the countershaft [212 in FIG. 3] with rotary power passing through a transverse pin [239] also coupled for rotation with the countershaft. As explained above, the pin diameter and material may be selected for the pin to act as a shear pin or mechanical fuse or weak link to protect other parts of the machine and to reduce the chance or severity of accidents or injury if a foreign object or part of a user's body were to become entrained into the rotating machinery.

Shaft spacers [234] may be included as needed to ensure proper location of the components and axial compression of the entire drive shaft assembly. The distal end of the shaft is retained in a bearing or a bushing. The drive shaft assembly may also optionally and preferably include a fluid seal [327] to prevent cleaning fluids from escaping the cleaning chamber and migrating to unwanted areas of the machine or leaking to the exterior.

Thus are disclosed a number of useful embodiments for configurations of scrubbing discs and associated components on a shaft assembly for a pruner cleaning machine. While certain features and aspects have been described with respect to exemplary embodiments, one skilled in the art will recognize that numerous modifications are possible. Also, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently and in summary, although many exemplary embodiments are described above, it will be appreciated that the invention is intended to cover all modifications and equivalents within the scope of the following claims.

What is claimed is:

1. A shaft assembly for a pruner cleaning apparatus, comprising a drive shaft having a rotational axis and a length, and defining a midplane perpendicular to said rotational axis, said midplane offset from an end of said shaft by a distance between 30% and 70% of said length of said shaft, at least one longitudinal engagement feature which rotates about said rotational axis of said drive shaft, two scrubbers with each located on opposite sides of said midplane, each scrubber further comprising a scrubbing face, with said scrubbing faces of both of said scrubbers facing each other, and a central aperture having a rotational drive feature complementary to said longitudinal engagement feature for coupled rotation therewith, and a scrubber barrel deposited between said two scrubbers, wherein said scrubber barrel is a grooved barrel comprising a coaxial stack of chamfered washers.

2. The shaft assembly of claim 1, wherein said at least one longitudinal engagement feature is integral to said drive shaft.

3. The shaft assembly of claim 1, wherein said at least one longitudinal engagement feature is integral to a drive barrel coupled to said drive shaft for rotation therewith.

4. The shaft assembly of claim 1, wherein at least one of said scrubbers further comprises bristles arranged into tufts.

5. The shaft assembly of claim 4 wherein at least one of said bristles extends from said scrubbing face of at least one of said two scrubbers past said midplane of said drive shaft.

6. The shaft assembly of claim 1, further comprising first and second drive barrels each deposited on opposite sides of said midplane to define first and second mutually inward-facing end faces, with each of said mutually inward-facing end faces further comprising at least one transverse ridge.

7. The shaft assembly of claim 6, wherein at least one end face from among said first and second mutually inward-facing end faces further comprises a friction grip feature.

8. The shaft assembly of claim 6, wherein an angular offset between a first transverse ridge on said first inward-facing end face of said first drive barrel and a second transverse ridge on said second inward-facing end face of said second drive barrel enforces an undulation in a portion of a rim of at least one of said chamfered washers.

9. The shaft assembly of claim 1, wherein said scrubber barrel further comprises cancellous material.

10. The shaft assembly of claim 1, wherein at least one of said two scrubbers further comprises cancellous material.

11. The shaft assembly of claim 1, wherein at least one of said two scrubbers further comprises a support hub.

12. The shaft assembly of claim 11, wherein said support hub is a conical support hub.

13. The shaft assembly of claim 1, wherein at least one of said two scrubbers further comprises a slipping clutch.

14. The shaft assembly of claim 1, wherein said scrubber barrel further comprises a slipping clutch.

15. The shaft assembly of claim 1, further comprising at least one drive component selected from the set of drive components consisting of:

a sheave, a drive belt, a V-belt, a timing belt, a timing belt sheave, a silent chain, a silent chain sprocket, a dog clutch, a slipping clutch, a universal joint, a drive belt having longitudinal ribs, a drive belt having a transverse rib, and a spur gear.

16. A shaft assembly for a pruner cleaning apparatus, comprising a drive shaft having a rotational axis and a length, and defining a midplane perpendicular to said rotational axis, said midplane offset from an end of said shaft by a distance between 30% and 70% of said length of said shaft, at least one longitudinal engagement feature which rotates about said rotational axis of said drive shaft, two scrubbers with each located on opposite sides of said midplane, each scrubber further comprising a scrubbing face, with said scrubbing faces of both of said scrubbers facing each other, and a central aperture having a rotational drive feature complementary to said longitudinal engagement feature for coupled rotation therewith, and a scrubber barrel deposited between said two scrubbers, wherein said scrubber barrel further comprises bristles arranged into tufts.

17. The shaft assembly of claim 16, wherein said at least one longitudinal engagement feature is integral to said drive shaft.

18. The shaft assembly of claim 16, wherein at least one of said two scrubbers further comprises cancellous material.

19. The shaft assembly of claim 16, wherein said at least one longitudinal engagement feature is integral to a drive barrel coupled to said drive shaft for rotation therewith.

20. The shaft assembly of claim 16, further comprising at least one drive component selected from the set of drive components consisting of:

a sheave, a drive belt, a V-belt, a timing belt, a timing belt sheave, a silent chain, a silent chain sprocket, a dog clutch, a slipping clutch, a universal joint, a drive belt having longitudinal ribs, a drive belt having a transverse rib, and a spur gear.

* * * * *